US006508633B2

(12) United States Patent
Matsubara et al.

(10) Patent No.: US 6,508,633 B2
(45) Date of Patent: Jan. 21, 2003

(54) SWASH PLATE TYPE COMPRESSOR OF VARIABLE CAPACITY TYPE

(75) Inventors: Ryo Matsubara, Kariya (JP); Tomoji Tarutani, Kariya (JP); Ken Suitou, Kariya (JP); Kenta Nishimura, Kariya (JP); Taku Adaniya, Kariya (JP); Masaki Ota, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 15 days.

(21) Appl. No.: 09/884,190

(22) Filed: Jun. 19, 2001

(65) Prior Publication Data

US 2001/0053326 A1 Dec. 20, 2001

(30) Foreign Application Priority Data

Jun. 19, 2000 (JP) ..... 2000-183159

(51) Int. Cl.[7] ..... F04B 1/26
(52) U.S. Cl. ..... 417/222.2; 92/73
(58) Field of Search ..... 417/222.1, 222.2; 92/73, 12.2, 71, 165 PR

(56) References Cited

U.S. PATENT DOCUMENTS 4,846,049 A 7/1989 Terauchi et al. ..... 92/12.2
5,063,829 A * 11/1991 Takao et al. ..... 92/71
5,706,716 A * 1/1998 Unemura ..... 92/165 PR
5,836,748 A * 11/1998 Kawaguchi et al. ..... 417/222.2
5,950,520 A * 9/1999 Kurosawa ..... 92/12.2
6,044,751 A * 4/2000 Kimura et al. ..... 92/71
6,076,449 A * 6/2000 Kawaguchi et al. ..... 92/12.2
2001/0049997 A1 * 12/2001 Ahn ..... 62/12.2
2002/0073839 A1 * 6/2002 Tagami ..... 92/73

FOREIGN PATENT DOCUMENTS

JP 7-91366 4/1995 ..... F04B/27/14

* cited by examiner

*Primary Examiner*—Teresa Walberg
*Assistant Examiner*—Leonid Fastovsky
(74) *Attorney, Agent, or Firm*—Morgan & Finnegan, LLP

(57) ABSTRACT

A swash plate type compressor of variable capacity type including a rotary drive shaft, a swash plate angle adjusting device for adjusting the inclination angle between a minimum and a maximum angle, and wherein the_swash plate has a first center point at the maximum inclination angle and a second center point at the minimum inclination angle, each of the center points being an intersection between an intermediate plane of the swash plate which is intermediate in the thickness direction and a centerline of the swash plate, the two center points being located on the rotation axis, or the first center point being located on the rotation axis or offset therefrom on one side of the rotation axis corresponding to the compression-end circumferential part of the swash plate, while the second center point is offset a larger distance from the rotation axis than the first center point.

11 Claims, 6 Drawing Sheets

PRIOR ART

SWASH PLATE TYPE COMPRESSOR OF VARIABLE CAPACITY TYPE

This application is based on Japanese Patent Application No. 2000-183159 filed Jun. 19, 2000, the contents of which are incorporated hereinto by reference.

BACKGROUND OF THE INVENTION

1. Field of the Invention

The present invention relates in general to a swash plate type compressor of variable capacity type, and more particularly to a technique for assuring stable behavior of the swash plate which is rotated during operation of the compressor.

2. Discussion of the Related Art

One example of a swash plate type compressor of variable capacity type is disclosed in JP-A-7-91366. The compressor disclosed in the publication comprises (a) a housing having a plurality of cylinder bores formed therein such that the cylinder bores are equiangularly arranged along a circle whose center lies on a centerline of the housing; (b) a rotary drive shaft which is rotatably supported by the housing such that an axis of rotation of the rotary drive shaft is aligned with the centerline of the housing; (c) a swash plate which is carried by the rotary drive shaft such that an angle of inclination of the swash plate with respect to a plane perpendicular to the axis of rotation of the rotary drive shaft is variable, and such that the swash plate is rotated together with the rotary drive shaft; (d) a plurality of pistons which are slidably fitted in the respective cylinder bores and which engage a radially outer portion of the swash plate, each piston being reciprocated between a compression stroke end and a suction stroke end during rotation of the swash plate; and (e) a swash plate angle adjusting device for adjusting the angle of inclination of the swash plate between a maximum inclination angle and a minimum inclination angle.

The compressor further comprises an engaging protrusion which extends from a body portion of the swash plate at an angle with respect to the centerline of the body portion. The engaging protrusion has at its free end a spherical portion which is held in engagement with an engaging hole formed in a rotary member fixed to the rotary drive shaft. The swash plate has a central through-hole formed through the thickness at its central portion. The rotary drive shaft extends through the through-hole for supporting the swash plate. The configuration of the through-hole permits a tilting motion of the swash plate between a perpendicular posture in which the swash plate is perpendicular to the rotation axis of the rotary drive shaft and an inclined posture in which the swash plate is inclined by a predetermined angle with respect to the rotation axis, namely, a rotary motion of the swash plate for changing its inclination angle.

While the swash plate which is inclined with respect to the rotation axis of the rotary drive shaft is rotated, the plurality of pistons which engage the radially outer portion of the swash plate are reciprocated within the respective cylinder bores, for thereby changing the volume of the pressurizing chamber which is defined by the end face of each piston and the inner surface of the cylinder bore. Described more specifically, the volume of the pressurizing chamber is increased during a suction stroke of the piston in which a gas is sucked into the pressurizing chamber, while the volume of the pressurizing chamber is decreased during a compression stroke of the piston in which the gas is compressed. The volume of the pressurizing chamber is minimum when the piston is at its compression stroke end, and the volume of the pressurizing chamber is maximum when the piston is at its suction stroke end. The radially outer portion of the swash plate includes a compression-end circumferential part which engages each piston when each piston is at its compression stroke end, and a suction-end circumferential part which engages each piston when each piston is at its suction stroke end. Since the body portion of the swash plate generally has a circular shape, the compression-end circumferential part and the suction-end circumferential part of the swash plate are opposite to each other diametrically of the rotary drive shaft. While the swash plate which is inclined by a predetermined angle is rotated for reciprocating each piston, the swash plate receives at one of its opposite inclined surfaces the reaction force from the piston which is at its compression stroke. In this case, owing to the effect of the inclined surface, a force acts on the swash plate in a direction from its suction-end circumferential part toward the compression-end circumferential part. Accordingly, the swash plate is rotated together with the rotary drive shaft while a circumferential portion of the inner circumferential surface of the central through-hole of the swash plate, which circumferential portion is on the side of the suction-end circumferential part of the swash plate, is held in pressing contact with the corresponding circumferential portion of the outer circumferential surface of the rotary drive shaft. The above-indicated circumferential portion of the inner circumferential surface of the thorough-hole on the side of the suction-end circumferential part of the swash plate is hereinafter referred to as "suction-end-side inner circumferential surface" of the through-hole.

Where the swash plate is rotated while it is placed in the substantially perpendicular posture relative to the rotation axis of the rotary drive shaft, the positions of the piston at its compression stroke end and suction stroke end in the axial direction of the rotary drive shaft are substantially identical with each other, causing substantially no change in the volume of the pressurizing chamber. Since the compression of the gas is not substantially effected in this state, the reaction force acting on the swash plate from the piston is substantially zero. In addition, the opposite surfaces of the swash plate which receive the reaction force of the piston are perpendicular to the rotation axis, in the substantially perpendicular posture of the swash plate. Accordingly, the above-indicated force acting on the swash plate owing to the effect of the inclined surface in the direction from the suction-end circumferential part toward the compression-end circumferential part of the swash plate is substantially zero or considerably small. It is, however, desirable that the suction-end-side inner circumferential surface of the through-hole of the swash plate is kept in pressing contact with the outer circumferential surface of the drive shaft by the force acting on the swash plate in the direction from its suction-end circumferential part toward the compression-end circumferential part. If the circumferential portion of the inner circumferential surface of the through-hole of the swash plate on the side of its compression-end circumferential part (hereinafter referred to as a "compression-end-side inner circumferential surface" of the through-hole) were held in pressing contact with the outer circumferential surface of the rotary drive shaft, the swash plate would be moved in its radial direction from its suction-end circumferential part toward the compression-end circumferential part during its tilting motion to increase the inclination angle. This movement causes undesirable butting noise due to a butting contact of the suction-end-side inner circumferential surface of the through-hole of the swash plate with the rotary drive shaft. Further, since the volume of the pressurizing chamber is abruptly changed due to the above-described movement of the swash plate, the discharge capacity of the compressor is also abruptly changed. To avoid these undesirable phenomena, it is preferable that the suction-end-side inner circumferential surface of the through-hole of the swash plate is always kept in pressing contact with the outer circumferential surface of the rotary drive shaft, irrespective of the inclination angle of the swash plate.

SUMMARY OF THE INVENTION

For permitting the swash plate to receive the force acting thereon in the direction from its suction-end circumferential part toward the compression-end circumferential part even while the swash plate is placed in the substantially perpendicular posture relative to the rotation axis, it is effective to design the swash plate such that the center of gravity of the swash plate is located on one side of the rotation axis of the rotary drive shaft, which one side corresponds to the compression-end circumferential part of the swash plate. The thus designed swash plate is subjected to the force acting thereon in the direction from the suction-end circumferential part toward the compression-end circumferential part, based on a centrifugal force. It is, however, desirable to minimize the magnitude of the centrifugal force because the centrifugal force deteriorates a dynamic balance of the rotating unit of the compressor.

It is an object of the present invention to provide a swash plate type compressor of variable capacity type, wherein the swash plate is rotated with the suction-end-side inner circumferential surface of the through-hole formed therein being kept in pressing contact with the outer circumferential surface of the rotary drive shaft, without deteriorating the dynamic balance of the rotating unit of the compressor.

The object indicated above may be achieved according to any one of the following forms or modes of the present invention, each of which is numbered like the appended claims and depend from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A swash plate type compressor of variable capacity type comprising: a housing having a plurality of cylinder bores formed therein such that the cylinder bores are arranged along a circle whose center lies on a centerline of the housing; a rotary drive shaft which is rotatably supported by the housing such that an axis of rotation of the rotary drive shaft is aligned with the centerline of the housing; a swash plate which is carried by the rotary drive shaft such that an angle of inclination of the swash plate with respect to a plane perpendicular to the axis of rotation of the rotary drive shaft is variable, and such that the swash plate is rotated together with the rotary drive shaft; a plurality of pistons which are slidably fitted in the respective cylinder bores and which engage a radially outer portion of the swash plate, each of the pistons being reciprocated between a compression stroke end and a suction stroke end by rotation of the swash plate, the radially outer portion of the swash plate including a compression-end circumferential part which engages each piston when each piston is located at the compression stroke end; a swash plate angle adjusting device for adjusting the angle of inclination of the swash plate between a minimum inclination angle and a maximum inclination angle, and wherein the swash plate has a first center point at the maximum inclination angle and a second center point at the minimum inclination angle, each of the first and second center points being an intersection between an intermediate plane of the swash plate which is intermediate in a direction of thickness thereof and a centerline of the swash plate, (a) the first center point and the second center point being located on the axis of rotation of the rotary drive shaft, or (b) the first center point being located on the axis of rotation or offset from the axis of rotation on one side of the axis of rotation, which one side corresponds to the compression-end circumferential part of the swash plate, while the second center point is offset a larger distance from the axis of rotation than the first center point.

In the conventional swash plate type compressor of variable capacity type, the first center point of the swash plate at its maximum inclination angle is located substantially on the rotation axis of the rotary drive shaft. As the inclination angle of the swash plate gradually decreases, the center point of the swash plate is initially moved to one side of the rotation axis corresponding to the compression-end circumferential part, and then moved to the other side of the rotation axis corresponding to the suction-end circumferential part. Thus, the second center point of the swash plate at its minimum inclination angle is located on the other side of the rotation axis corresponding to the suction-end circumferential part. In the conventional compressor, the center point of the swash plate is moved so as not to offset a large distance from the rotation axis. The center of gravity of the swash plate is located on one of opposite sides of its intermediate plane, which one side is remote from the cylinder bore of the housing. Accordingly, in the conventional compressor, the second center of gravity of the swash plate at its minimum inclination angle is offset from the first center of gravity at the maximum inclination angle on the side of the suction-end circumferential part of the swash plate.

As described above, for assuring the optimum operating condition of the compressor, it is desirable to locate the center of gravity of the swash plate on one side of the rotation axis corresponding to the compression-end circumferential part, so as to cause the centrifugal force acting on the swash plate in the direction from the suction-end circumferential part toward the compression-end circumferential part while minimizing the magnitude of the centrifugal force. Further, it is desirable that the centrifugal force acting on the swash plate at the minimum inclination angle is larger than that acting on the swash plate at the maximum inclination angle. The swash plate at the maximum inclination angle receives at one of its opposite inclined surfaces the reaction force of the piston when the piston is at the compression stroke, so that the swash plate receives the force acting thereon in the direction from the suction-end circumferential part toward the compression-end circumferential part owing to the effect of the inclined surface. In contrast, the above-indicated force is substantially zero or considerably small while the swash plate is at the minimum inclination angle.

In the conventional swash plate type compressor, however, the second center of gravity of the swash plate at the minimum inclination angle is offset from the first center of gravity at the maximum inclination angle on the side of the suction-end circumferential part of the swash plate. This positional relationship between the first and second centers of gravity of the swash plate at the maximum and minimum inclination angles is contrary to the desired one. In the compressor constructed according to the present invention wherein the first and second center points of the swash plate at the maximum and minimum inclination angles are located on the rotation axis, or the first center point at the maximum inclination angle is located on the rotation axis or offset from the rotation axis on one side of the rotation axis corresponding to the compression-end circumferential part of the swash plate, while the second center point at the minimum inclination angle is offset a larger distance from the rotation axis than the first center point at the maximum inclination angle, the positional relationship between the first and second centers of gravity at the maximum and minimum inclination angles is more desirable than that of the conventional compressor described above. Accordingly, it is easier in the present arrangement than in the conventional arrangement to lower the maximum value of the centrifugal force while permitting the swash plate to receive the centrifugal force acting thereon in the direction from the suction-end circumferential part toward the compression-end circumferential part at both of the maximum and minimum inclination angles. In case where the second center of gravity at the minimum inclination angle is located on the other side of the rotation axis corresponding to the suction-end circumferential surface of the swash plate, the swash plate is subjected to a centrifugal force acting thereon in the reverse direction from the compression-end circumferential part toward the suction-end circumferential part. Even in this case, since the distance between the second center of gravity which is located on the other side of the rotation axis corresponding to the suction-end circumferential part of the swash plate and the rotation axis is smaller in the present arrangement than that in the conventional arrangement, the magnitude of the centrifugal force acting on the swash plate at the minimum inclination angle in the above-indicated reverse direction is accordingly small. Accordingly, even in this arrangement, it is easier than in the conventional arrangement to permit the suction-end-side inner circumferential surface of the through-hole of the swash plate to be kept in pressing contact with the outer circumferential surface of the rotation axis. Where the inclination angle of the swash plate at the minimum inclination is a positive value rather than zero, for instance, the swash plate receives the force acting thereon in the direction from the suction-end circumferential part toward the compression-end circumferential part, based on the reaction force of the piston at its compression stroke. If this force acting on the swash plate in the direction from the suction end side toward the compression end side is made larger than the centrifugal force acting on the swash plate in the reverse direction from the compression end side toward the suction end side; it is possible that the suction-end-side inner circumferential surface of the through-hole of the swash plate is kept in pressing contact with the outer circumferential surface of the rotary drive shaft while the swash plate is at the minimum inclination angle. Even where the inclination angle of the swash plate at the minimum inclination is zero, the suction-end-side inner circumferential surface of the through-hole of the swash plate can be kept in a pressing contact with the outer circumferential surface of the rotary drive shaft, by providing suitable biasing means such as a spring between the rotary drive shaft and the swash plate, for biasing the swash plate in the direction from the suction-end circumferential part toward the compression-end circumferential part. Thus, if the inclination angle of the swash plate at the minimum inclination is a positive value (larger than zero) or the biasing means is provided for biasing the swash plate as described above, the suction-end-side inner circumferential surface of the through-hole of the swash plate can be kept in pressing contact with the outer circumferential surface of the rotary drive shaft without employing the arrangement of the present invention. It is noted, however, that the inclination angle of the swash plate at the minimum inclination and the biasing force for biasing the swash plate in the direction from the suction-end side toward the compression-end side can be made smaller in the present arrangement.

(2) A swash plate type compressor of variable capacity type comprising: a housing having a plurality of cylinder bores formed therein such that the cylinder bores are arranged along a circle whose center lies on a centerline of the housing; a rotary drive shaft which is rotatably supported by the housing such that an axis of rotation of the rotary drive shaft is aligned with the centerline of the housing; a swash plate which is carried by the rotary drive shaft such that an angle of inclination of the swash plate with respect to a plane perpendicular to the axis of rotation of the rotary drive shaft is variable, and such that the swash plate is rotated together with the rotary drive shaft; a plurality of pistons which are slidably fitted in the respective cylinder bores and which engage a radially outer portion of the swash plate, each of the pistons being reciprocated between a compression stroke end and a suction stroke end by rotation of the swash plate, the radially outer portion of the swash plate including a compression-end circumferential part which engages each piston when each piston is located at the compression stroke end; a swash plate angle adjusting device for adjusting the angle of inclination of the swash plate between a minimum inclination angle and a maximum inclination angle, and wherein the swash plate has a first center of gravity at the maximum inclination angle and a second center of gravity at the minimum inclination angle, the first center of gravity and the second center of gravity being located on the axis of rotation of the rotary shaft or offset a substantially equal distance from the axis of rotation on one side of the axis of rotation, which one side corresponds to the compression-end circumferential part of the swash plate.

In the above mode (2) of the invention, the second center of gravity of the swash plate at the minimum inclination angle and the first center of gravity at the maximum inclination angle are offset a substantially equal distance from the axis of rotation of the rotary drive shaft. Namely, the distance between the second center of gravity at the minimum inclination angle and the rotation axis may be just equal to, slightly larger or smaller than, the distance between the first center of gravity at the maximum inclination angle and the rotation axis. The present arrangement permits the swash plate at both of the minimum inclination angle and maximum inclination angle to receive the centrifugal force acting thereon in the direction from the suction-end circumferential part toward the compression-end circumferential part while minimizing the maximum value of the centrifugal force to a required level.

(3) A swash plate type compressor of variable capacity type comprising: a housing having a plurality of cylinder bores formed therein such that the cylinder bores are arranged along a circle whose center lies on a centerline of the housing; a rotary drive shaft which is rotatably supported by the housing such that an axis of rotation of the rotary drive shaft is aligned with the centerline of the housing; a swash plate which is carried by the rotary drive shaft such that an angle of inclination of the swash plate with respect to a plane perpendicular to the axis of rotation of the rotary drive shaft is variable, and such that the swash plate is rotated together with the rotary drive shaft; a plurality of pistons which are slidably fitted in the respective cylinder bores and which engage a radially outer portion of the swash plate, each of the pistons being reciprocated between a compression stroke end and a suction stroke end by rotation of the swash plate, the radially outer portion of the swash plate including a compression-end circumferential part which engages each piston when each piston is located at the compression stroke end; a swash plate angle adjusting device for adjusting the angle of inclination of the swash plate between a minimum inclination angle and a maximum inclination angle, and wherein the swash plate has a first center of gravity at the maximum inclination angle and a second center of gravity at the minimum inclination angle, the second center of gravity being offset from the first center of gravity on the side of the compression-end circumferential part of the swash plate.

In the arrangement according to the above mode (3), the maximum value of the centrifugal force acting on the swash plate can be easily made smaller than that in the conventional arrangement while biasing the swash plate in the direction from the suction-end circumferential part toward the compression-end circumferential part at both of the minimum inclination angle and maximum inclination angle of the swash plate.

(4) A swash plate type compressor according to the above mode (3), wherein the second center of gravity is located on the axis of rotation of the rotary drive shaft or offset from the axis of rotation on one side of the axis of rotation, which one side corresponds to the compression-end circumferential part of the swash plate.

In one example according to the above mode (4), the second center of gravity of the swash plate at the minimum inclination angle is located on one side of the rotation axis of the rotary drive shaft corresponding to the compression-end circumferential part of the swash plate, while the first center of gravity at the maximum inclination angle is located on the other side of the rotation axis corresponding to the suction-end circumferential part of the swash plate.

In this arrangement, the centrifugal force acts on the swash plate in the direction from the suction-end circumferential part toward the compression-end circumferential part when the swash plate is at the minimum inclination angle where the force acting on the swash plate in the same direction owing to the effect of the inclined surface is not expected or insufficient. This arrangement is effective to stabilize the behavior of the swash plate.

In another example according to the above mode (4), the first center of gravity of the swash plate at the maximum inclination angle and the second center of gravity at the minimum inclination angle are both located on one side of the rotation axis corresponding to the compression-end circumferential part of the swash plate, and the second center of gravity is offset a larger distance from the rotation axis than the first center of gravity.

In this arrangement, the centrifugal force acts on the swash plate in the direction from the suction-end circumferential part toward the compression-end circumferential part both when the swash plate is at the minimum inclination angle and when the swash plate is at the maximum inclination angle. Further, the centrifugal force acting on the swash plate at the minimum inclination angle is larger than that at the maximum inclination angle. Accordingly, the swash plate type compressor of variable capacity type according to the present arrangement can be operated in a condition which is optimum or almost optimum from the viewpoint of the behavior of the swash plate. It is particularly desirable that the second center of gravity of the swash plate at the minimum inclination angle is offset a larger distance from the rotation axis than any other centers of gravity of the swash plate at any other inclination angles.

(5) A swash plate type compressor according to any one of the above modes (1)–(4), further comprising: a first engaging portion which is offset from the axis of rotation of the rotary drive shaft and which is rotatable together with the rotary drive shaft; and a second engaging portion which is fixed to the swash plate and which engages the first engaging portion such that the swash plate is tiltable relative to the axis of rotation of the rotary drive shaft so as to change the angle of inclination thereof, and such that the swash plate is inhibited from rotating relative to the rotary drive shaft.

The rotation of the rotary drive shaft can be effectively transmitted to the swash plate owing to the engagement of the first and second engaging portions described above.

(6) A swash plate type compressor according to the above mode (5), wherein the first engaging portion is provided on a rotary member which is fixed to the rotary drive shaft.

The first engaging portion may be provided on the rotary drive shaft. The present arrangement wherein the first engaging portion is provided on the rotary member fixed to the rotary drive shaft facilitates the installation of the first engaging portion.

(7) A swash plate type compressor according to the above mode (6), wherein the radially outer portion of the swash plate further includes a suction-end circumferential part which engages each piston when each piston is located at the suction stroke end, the suction-end circumferential part being opposite to the compression-end circumferential part diametrically of the rotary drive shaft, and wherein the rotary member has a center of gravity which is located on the axis of rotation of the rotary drive shaft or offset from the axis of rotation on the other side of the axis of rotation corresponding to the suction-end circumferential part of the swash plate.

For stable behavior of the swash plate, it is effective to locate the center of gravity of the swash plate on one side of the rotation axis of the rotary drive shaft corresponding to the compression-end circumferential part. In this case, however, the dynamic balance of the swash plate itself deteriorates to some extent. In view of this, if the center of gravity of the rotary member is located on the other side of the rotation axis corresponding to the suction-end circumferential part of the swash plate, the centrifugal force acting on the swash plate is offset or reduced by the centrifugal force acting on the rotary member. In particular, in the swash plate type compressor of variable capacity type constructed according to the above mode (2) of the invention wherein the first center of gravity and the second center of gravity are both located on one side of the rotation axis corresponding to the compression-end circumferential part of the swash plate, and the first and second centers of gravity are offset from the rotation axis by a substantially equal distance, the centrifugal force acting on the swash plate is substantially constant irrespective of the inclination angle of the swash plate. Accordingly, if the compressor is designed such that the center of gravity of the rotary member is located on the other side of the rotation axis corresponding to the suction-end circumferential part of the swash plate, and such that the magnitude of the centrifugal force acting on the rotary member is substantially equal to that acting on the swash plate, the dynamic balance of the rotating unit of the compressor including the rotary drive shaft, swash plate and rotary member can be maintained in an optimum condition irrespective of the inclination angle of the swash plate. As a result, the swash plate type compressor of variable capacity type does not suffer from undesirable vibration which would be otherwise caused by deteriorated dynamic balance of its rotation unit, regardless of its discharge capacity.

(8) A swash plate type compressor according to any one of the above modes (5)–(7), wherein the first engaging portion comprises an engaging hole having a circular shape in transverse cross section, and the second engaging portion is a protruding member which protrudes from a body portion of the swash plate such that the protruding member is inclined with respect to the intermediate plane of the swash plate, the protruding member having at a distal end thereof a spherical portion which is slidably fitted into the engaging hole of the first engaging portion.

(9) A swash plate type compressor according to any one of the above modes (1)–(8), further comprising a stopper for limiting a movement of the swash plate relative to the rotary drive shaft in a direction from the suction-end circumferential part of the swash plate toward the compression-end circumferential part of the swash plate, the stopper being formed at a portion of an inner circumferential surface of a through-hole formed through a central part of the swash plate, which portion is located on the side of the suction-end circumferential part of the swash plate, the stopper limiting the movement of the swash plate by a contact thereof with a corresponding portion of an outer circumferential surface of the rotary drive shaft.

(10) A swash plate type compressor according to the above mode (9), wherein the stopper has a curved shape in cross section in a plane which passes the compression-end circumferential part of the swash plate and the suction-end circumferential part of the swash plate and which includes the rotation axis of the rotary drive shaft.

In the swash plate type compressor of variable capacity type constructed according to any one of the above modes (1)–(4), the curved cross sectional shape and the position of the stopper are determined to satisfy the condition described in any one of the above modes (1)–(4). The curved cross sectional shape comprises an arcuate shape as defined in the following mode (11). Where the curved cross sectional shape is other than the arcuate shape, it is possible to change the position of the swash plate in a direction perpendicular to the rotary drive shaft while the stopper formed on the swash plate is held in contact with the rotary drive shaft, by appropriately changing the curved cross sectional shape of the stopper.

(11) A swash plate type compressor according to the above mode (10), wherein the curved cross sectional shape of the stopper is arcuate.

In the swash plate type compressor of variable capacity type constructed according to any one of the above modes (1)–(4), the position of the center of the arcuate shape of the stopper relative to the center point or the center of gravity of the swash plate is determined to satisfy the condition described in any one of the above modes (1)–(4).

BRIEF DESCRIPTION OF THE DRAWINGS

The above and optional objects, features, advantages and technical and industrial significance of the present invention will be better understood and appreciated by reading the following detailed description of the presently preferred embodiments of the invention, when considered in connection with the accompanying drawings, in which.

DETAILED DESCRIPTION OF THE PREFERRED EMBODIMENTS

Referring to the accompanying drawings, there will be described presently preferred embodiments of the present invention as applied to a swash plate type compressor of variable capacity type used for an air conditioning system of an automotive vehicle.

Figure 1:
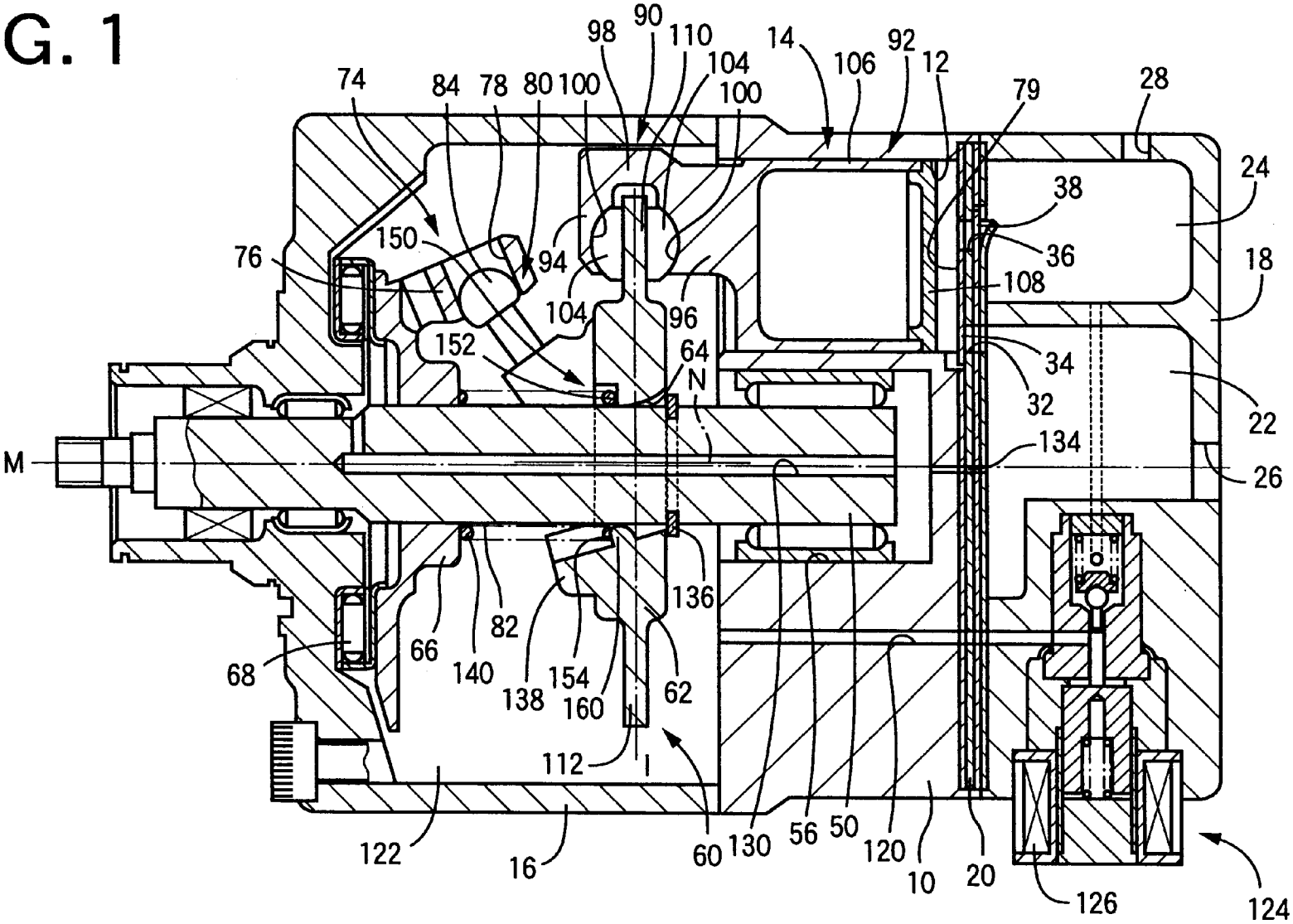
FIG. 1 is a front elevational view in cross section of a swash plate type compressor of variable capacity type constructed according to one embodiment of the present invention, wherein the swash plate is at its minimum inclination angle.

Referring first to FIG. 1, there is shown a swash plate type compressor of variable capacity type. In FIG. 1, reference numeral 10 denotes a cylinder block having a plurality of cylinder bores 12 formed so as to extend in its axial direction such that the cylinder bores 12 are equiangularly arranged along a circle whose center lies on a centerline of the cylinder block 10. A plurality of single-headed pistons 14 (hereinafter referred to simply as "pistons 14") are reciprocably received in the respective cylinder bores 12. To one of the axially opposite end faces of the cylinder block 10, (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor. The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 32, suction valves 34, discharge ports 36 and discharge valves 38.

A rotary drive shaft 50 is disposed in the cylinder block 10 and the front housing 16 such that the axis of rotation M of the rotary drive shaft 50 is aligned with the centerline of the cylinder block 10. The rotary drive shaft 50 is supported at its opposite end portions by the front housing 16 and the cylinder block 10, respectively, via respective bearings. The cylinder block 10 has a central bearing hole 56 formed in a central portion thereof, and the bearing is disposed in this central bearing hole 56, for supporting the drive shaft 50 at its rear end portion. The front end portion of the drive shaft 50 is connected, through a clutch mechanism such as an electromagnetic clutch, to an external drive source (not shown) in the form of an engine of an automotive vehicle. In operation of the compressor, the drive shaft 50 is connected through the clutch mechanism to the vehicle engine in operation so that the drive shaft 50 is rotated about its axis M.

The rotary drive shaft 50 carries a swash plate 60 such that the swash plate 60 is axially movable and tiltable relative to the drive shaft 50. The swash plate 60 has a body portion 62. A central through-hole 64 is formed through a central portion of the swash plate 60 such that the through-hole 64 includes a centerline N of the body portion 62 of the swash plate 60. The rotary drive shaft 50 extends through the through-hole 64 for supporting the swash plate 60. To the rotary drive shaft 50, there is fixed a rotary member 66 as a torque transmitting member, which is held in engagement with the front housing 16 through a thrust bearing 68. The swash plate 60 is rotated with the rotary drive shaft 50 by a hinge mechanism 74 during rotation of the rotary drive shaft 50. The hinge mechanism 74 guides the swash plate 60 for its axial and tilting motions. The hinge mechanism 74 includes: a pair of support arms 76 fixed to the rotary member 66 at respective two circumferential portions thereof which are offset from the rotation axis M of the rotary drive shaft 50 and which are opposite to each other in the diametric direction of the rotary member 66; engaging protrusions 80 which are formed on the body portion 62 of the swash plate 60 and which slidably engage engaging holes 78 formed in the support arms 76, the through-hole 64 of the swash plate 60, and an outer circumferential surface 82 of the rotary drive shaft 50. Each of the engaging protrusions 80 protrudes from one of the opposite major surfaces of the body portion 62 of the swash plate 60 on the side of the rotary member 66, so as to extend in a direction which is inclined with respect to the centerline N of the swash plate 60 (i.e., in a radially outward direction of the compressor). Each engaging protrusion 80 has, at its distal end, a spherical portion 84 which is slidably fitted into the corresponding engaging hole 78 having a circular shape in transverse cross section. In the present embodiment, the swash plate 60, rotary drive shaft 50, and hinge mechanism 74 constitute a major portion of a reciprocating drive device for reciprocating the pistons 14. The engaging hole 78 formed in each support arm 76 functions as a first engaging portion, while each engaging protrusion 80 functions as a second engaging portion.

The piston 14 indicated above includes an engaging portion 90 engaging the swash plate 60, and a hollow cylindrical head portion 92 formed integrally with the engaging portion 90 and fitted in the corresponding cylinder bore 12. The engaging portion 90 has a generally U-shape in cross section, and includes a base section 98 which defines the bottom of the U-shape, and a pair of substantially parallel arm sections 94, 96 which extend from the base section 98 in a direction perpendicular to the axis of the piston 14. The two opposed lateral walls of the arm sections 94, 96 have respective recesses 100 which are opposed to each other. Each of the recesses 100 is defined by a part-spherical inner surface of the lateral wall. The two part-spherical inner surfaces are of a single spherical surface. The engaging portion 90 engages the swash plate 60 through a pair of hemi-spherical shoes 104. The hemi-spherical shoes 104 are slidably received at their hemispherical surfaces in the respective recesses 100 and engage the radially outer portions of the opposite surfaces of the swash plate 60 at their flat surfaces. The head portion 92 of the piston 14 includes a cylindrical body portion 106 having an open end and a closed end, and a cap 108 as a closure member which is fixed to the cylindrical body portion 106 for closing its open end. The cylindrical body portion 106 is formed integrally at its bottom with the engaging portion 90 on the side of its arm section 96.

The cylinder block 10 and the piston 14 are formed of a metallic material in the form of an aluminum alloy. The piston 14 is coated at its outer circumferential surface with a coating film of a fluoro resin. The fluoro resin coating prevents a direct contact of the aluminum alloy of the piston 14 with the aluminum alloy of the cylinder block 10 so as to prevent seizure therebetween, and makes it possible to minimize the amount of clearance between the piston 14 and the cylinder bore 12. It is noted that the cylinder block 10 and the piston 14 may be formed of an aluminum silicon alloy. Other materials may be used for the cylinder block 10, the piston 14, and the coating film.

Figure 2:
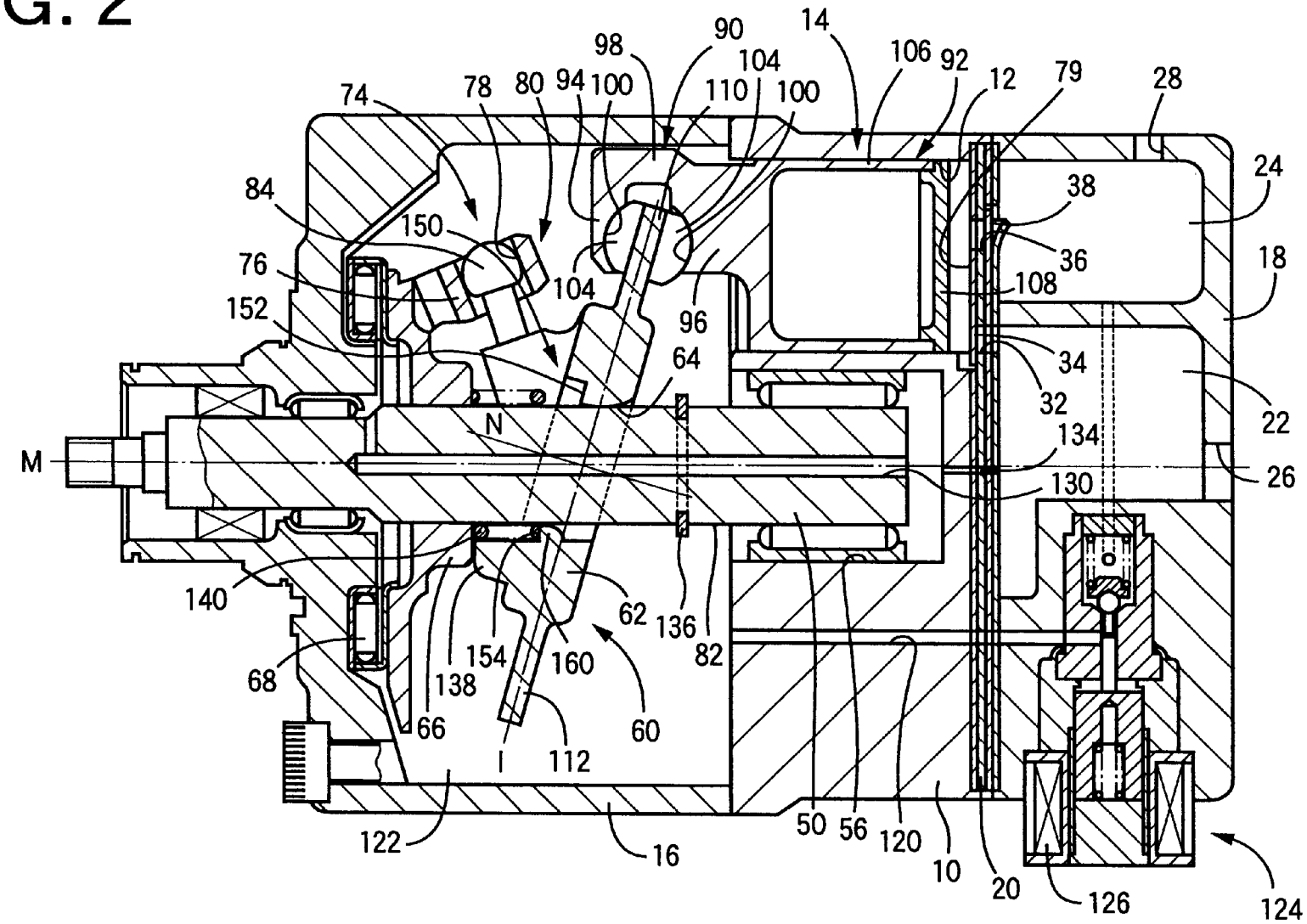
FIG. 2 is a front elevational view in cross section of the compressor of FIG. 1, wherein the swash plate is at its maximum inclination angle.

A rotary motion of the swash plate 60 is converted into a reciprocating linear motion of the piston 14 through the shoes 104. A refrigerant gas in the suction chamber 22 is sucked into the pressurizing chamber 79 through the suction port 32 and the suction valve 34 when the piston 14 is moved from its upper dead point to its lower dead point, that is, when the piston 14 is in the suction stroke. The refrigerant gas in the pressurizing chamber 79 is pressurized by the piston 14 when the piston 14 is moved from its lower dead point to its upper dead point, that is, when the piston 14 is in the compression stroke. The pressurized refrigerant gas is discharged into the discharge chamber 24 through the discharge port 36 and the discharge valve 38. The swash plate 60 includes a compression-end circumferential part 110 which engages each of the plurality of pistons 14 when each piston is located at its compression stroke end, and a suction-end circumferential part 112 which engages each piston, 14 when each piston 14 is located at its suction stroke end. The compression-end circumferential part 110 and the suction-end circumferential part 112 are opposite to each other diametrically of :the rotary drive shaft 50. The compression-end and suction-end circumferential parts 110, 112 move in the rotating direction of the drive shaft 50 during a rotary movement of a rotary unit including the drive shaft 50, swash plate 60, and rotary member 66. In FIGS. 1 and 2, the compression-end circumferential part 110 of the swash plate 60 is located at the highest position as seen in the vertical direction of FIGS. 1 and 2, while the suction-end circumferential part 112 is located at the lowest position. A reaction force acts on the piston 14 in the axial direction as a result of compression of the refrigerant gas in the pressurizing chamber 79. This compression reaction force is received by the housing assembly constituted by the cylinder block 10 and the front and rear housings 16, 18 through the piston 14, swash plate 60, rotary member 66 and thrust bearing 68. The engaging portion 90 of the piston 14 has an integrally formed rotation preventive part (not shown), which is arranged to contact the inner circumferential surface of the front housing 16, for thereby preventing a rotary motion of the piston 14 about its centerline to prevent an interference between the piston 14 and the swash plate 60.

The cylinder block 10 has a supply passage 120 formed therethrough for communication between the discharge chamber 24 and a crank chamber 122 which is defined between the front housing 16 and the cylinder block 10. The supply passage 120 is connected to a solenoid-operated control valve 124 provided to control the pressure in the crank chamber 122. The solenoid-operated control valve 124 has a solenoid coil 126 which is selectively energized and de-energized by a control device (not shown) constituted principally by a computer. During energization of the solenoid coil 126, the amount of electric current applied to the solenoid coil 126 is controlled depending upon the air conditioner load, so that the amount of opening of the control valve 124 is controlled according to the air conditioner load.

The rotary drive shaft 50 has a bleeding passage 130 formed therethrough. The bleeding passage 130 is open at one of its opposite ends to the central bearing hole 56, and is open to the crank chamber 122 at the other end. The central bearing hole 56 communicates at its bottom with the suction chamber 22 through a communication port 134.

The present swash plate type compressor is a variable capacity type. By controlling the pressure in the crank chamber 122 by utilizing a difference between the pressure in the discharge chamber 24 as a high-pressure source and the pressure in the suction chamber 22 as a low pressure source, a difference between the pressure in the crank chamber 122 which acts on the front side of the piston 14 and the pressure in the pressurizing chamber 79 is regulated to change the angle of inclination of the swash plate 60 with respect to a plane perpendicular to the axis M of rotation of the drive shaft 50, for thereby changing the reciprocating stroke (suction and compression strokes) of the piston 14, whereby the discharge capacity of the compressor can be adjusted. Described in detail, the pressure in the crank chamber 122 is controlled by controlling the solenoid-operated control valve 124 to selectively connect and disconnect the crank chamber 122 to and from the discharge chamber 24.

Described more specifically, while the solenoid coil 126 is in the de-energized state, the solenoid-operated control valve 124 is held in its fully open state, and the supply passage 120 is opened for permitting the pressurized refrigerant gas to be delivered from the discharge chamber 24 into the crank chamber 122, resulting in an increase in the pressure in the crank chamber 122, and the angle of inclination of the swash plate 60 is minimized. Namely, the swash plate 60 is placed in a substantially perpendicular posture relative to the axis M of rotation of the rotary drive shaft, as shown in FIG. 1. The reciprocating stroke of the piston 14 which is reciprocated by rotation of the swash plate 60 decreases with a decrease of the angle of inclination of the swash plate 60, so as to reduce an amount of change of the volume of the pressurizing chamber 79, whereby the discharge capacity of the compressor is minimized. While the solenoid coil 126 is in the energized state, the amount of the pressurized refrigerant gas in the discharge chamber 24 to be delivered into the crank chamber 122 is reduced, by increasing an amount of electric current applied to the solenoid coil 126 to reduce (or zero) the amount of opening of the solenoid-operated control valve 124. In this condition, the refrigerant gas in the crank chamber 122 flows into the suction chamber 22 through the bleeding passage 130 and the communication port 134, so that the pressure in the crank chamber 122 is lowered, to thereby increase the angle of inclination of the swash plate 60. Accordingly, the amount of change of the volume of the pressurizing chamber 79 is increased, whereby the discharge capacity of the compressor is increased. When the supply passage 120 is closed upon energization of the solenoid coil 126, the pressurized refrigerant gas in the discharge chamber 24 is not delivered into the crank chamber 122, whereby the angle of inclination of the swash plate 60 is maximized to maximize the discharge capacity of the compressor.

The minimum angle of inclination of the swash plate 60 is limited by abutting contact of the swash plate 60 with a stop 136 in the form of a ring fixedly fitted on the drive shaft 50, while the maximum angle of inclination of the swash plate 60 is limited by abutting contact of a part-cylindrical stop 138 formed on the swash plate 60, with the rotary member 66. In the present embodiment, the supply passage 120, the crank chamber 122, the solenoid-operated control valve 124, the bleeding passage 130, the communication port 134, and the control device for controlling the solenoid-operated control valve 124 cooperate to constitute a major portion of an angle adjusting device for controlling the angle of inclination of the swash plate 60.

Between the rotary member 66 and one of the opposite major surfaces of the swash plate 60 which is remote from the rear housing 18, an elastic member in the form of a compression coil spring 140 is disposed to function as biasing means. This compression coil spring 140 is received at one of its opposite ends by the rotary member 66, and at the other end by the body portion 62 of the swash plate 60 on the side of the engaging protrusion 80, namely, on the side which is nearer to the rotary member 66, so that the compression coil spring 140 biases the swash plate 60 at its minimum inclination angle.

At one of axially opposite ends of the through-hole 64 of the swash plate 60, which end is nearer to the rotary member 66, a circumferential groove 150 is formed. While the swash plate 60 is at its maximum inclination position, the compression coil spring 140 is received at one end thereof which is remote from the rotary member 66 by a bearing surface 154 which partially defines the circumferential groove 150 and which is perpendicular to the centerline of the housing assembly of the compressor when the inclination angle of the swash plate 60 is maximum. While the swash plate 60 is at its minimum inclination position, the compression coil spring 140 is received at the above-indicated one end thereof by a bearing surface 152 which partially defines the circumferential groove 150 and which is perpendicular to the centerline of the housing assembly when the inclination angle of the swash plate 60 is minimum. When the compressor is turned off, the swash plate is moved to the minimum inclination position by a biasing force of the compression coil spring 140 and is kept at the position until the compressor is re-started.

Figure 3:
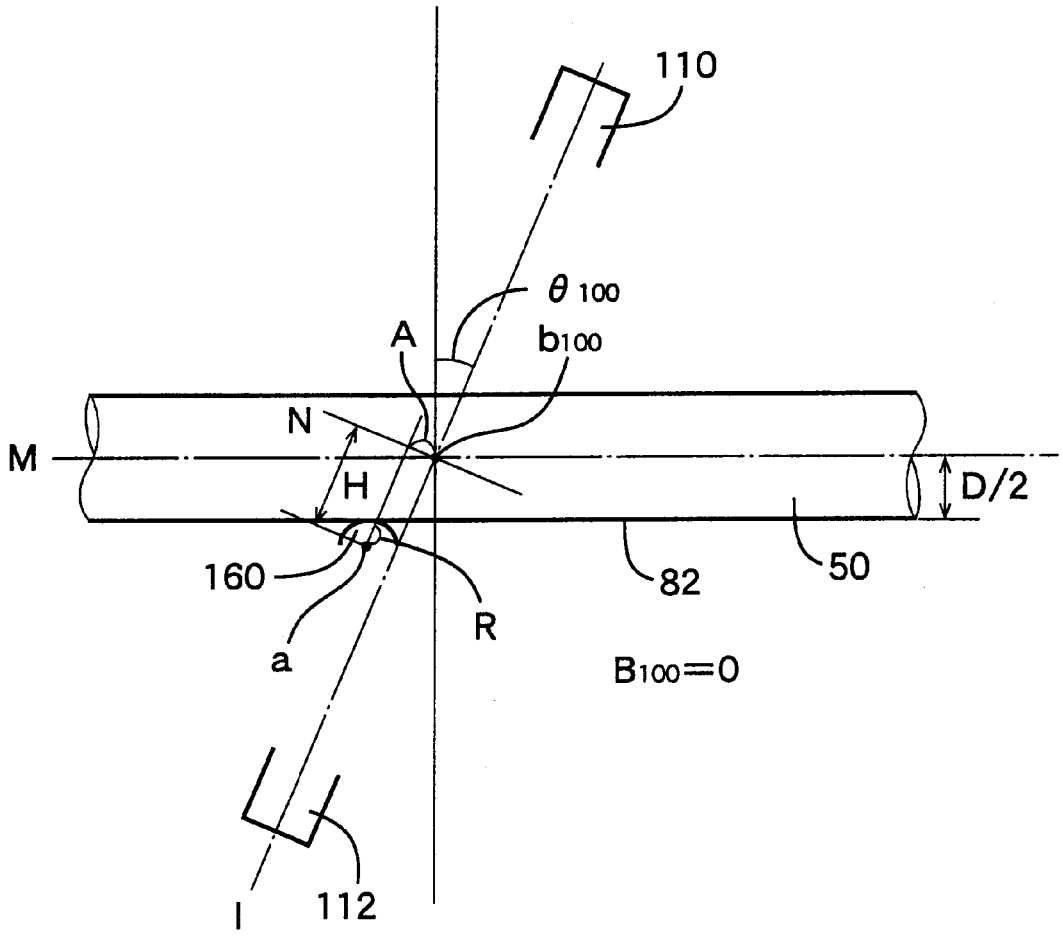
FIG. 3 is a schematic view showing a relative positional relationship of the center point of the swash plate at the maximum inclination angle, rotation axis of the rotary drive shaft, and center of the arc of stopper.

A stopper 160 having a curved surface is formed at a portion of the inner circumferential surface of the through-hole 64 of the swash plate 60, which portion is located on the side of the suction-end circumferential part 112 of the swash plate 60. The stopper 160 limits a movement of the swash plate 60 in a direction from its suction-end circumferential part 112 toward its compression-end circumferential part 110. The stopper 160 has an arcuate shape in cross section in a plane which passes the compression-end and suction-end circumferential parts 110, 112 of the swash plate 60 and which includes the rotation axis M of the rotary drive shaft 50. In the present embodiment, the stopper 160 is formed adjacent to the bearing surface 154 described above and has a part-circular cross sectional shape. As shown in FIG. 3, the stopper 160 is formed such that the center a of the arc of its part-circular shape is located on one of opposite sides of an intermediate plane 1, which side is nearer to the engaging protrusion 80. The intermediate plane 1 is intermediate in a direction of thickness of the body portion 62 of the swash plate 60, i.e., in a direction parallel to the centerline N of the swash plate 60. The configuration of the through-hole 64 of the swash plate 60 is designed so as to permit the tilting motion of the swash plate 60 while limiting the movement of the swash plate 60 relative to the rotary drive shaft 50 in the direction toward its compression-end circumferential part 110, by contact of the stopper 160 with the outer circumferential surface 82 of the rotary drive shaft 50.

The positional relationship of the center a of the arc of the stopper 160 relative to the center point b of the body portion 62 of the swash plate 60, i.e., the intersection between the centerline N of the swash plate 60 and the intermediate plane 1, is determined based on the following formulas. Initially, the following formula is established when the swash plate 60 is at its maximum inclination position, as schematically shown in FIG. 3:

$$D/2+R=H\cos\theta_{100}-A\sin\theta_{100}-B_{100}$$

wherein,

D/2: a radius of the rotary drive shaft 50,

R: a radius of the arc of the stopper 160,

H: a distance between the center a of the arc of the stopper 160 and the centerline N of the swash plate 60, $\theta_{100}$: the inclination angle of the swash plate 60 at its maximum inclination position where the discharge capacity of the compressor is maximum (100%), A: a distance between the center a of the arc of the stopper 160 and the intermediate plane 1 of the swash plate 60, and B: a distance between the center point b of the swash plate 60 and the rotation axis M of the rotary drive shaft 50.

By transposing the term "$B_{100}$" in the right-hand side of the above formula to the left-hand side of the formula and transposing the term "D/2+R" in the left-hand side to the right-hand side, the following formula (1) is established:

$$B_{100}=H\cos\theta_{100}-A\sin\theta_{100}-D/2-R \quad (1)$$

Figure 4:
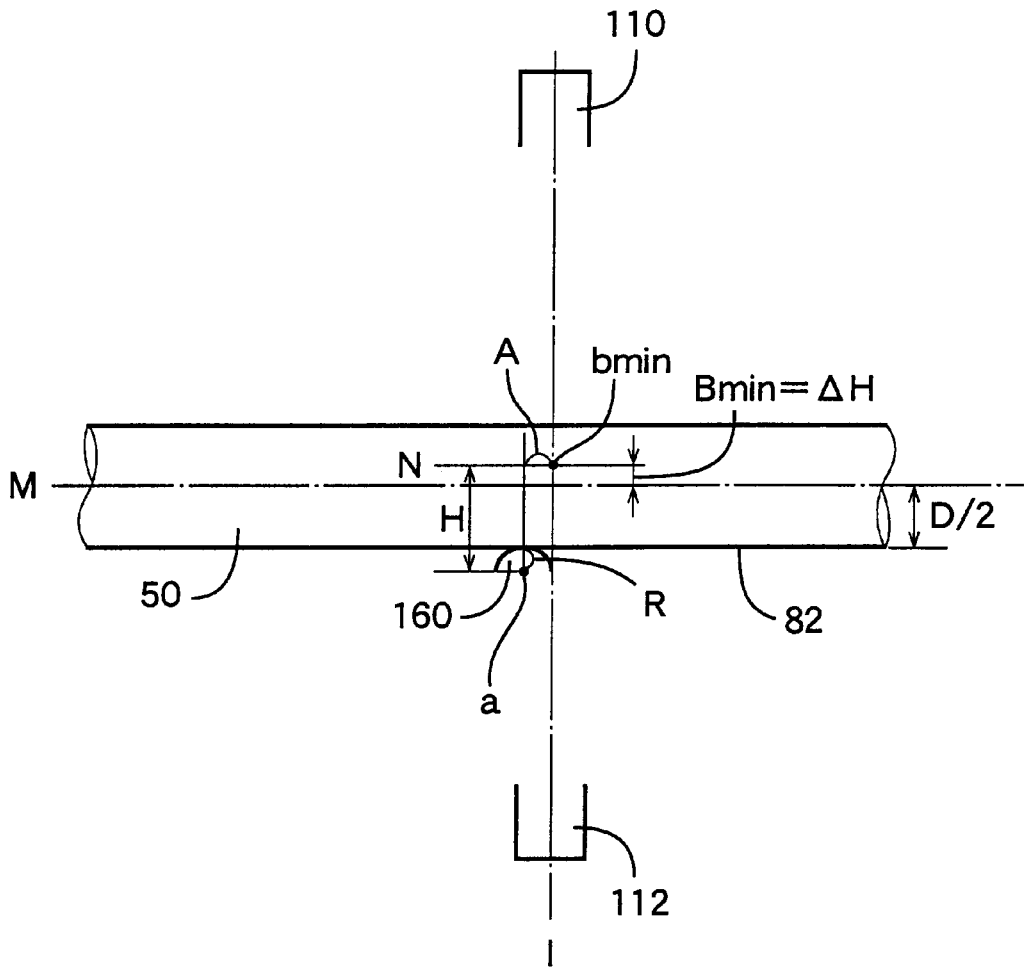
FIG. 4 is a schematic view showing a relative positional relationship of the center point of the swash plate at the minimum inclination angle, rotation axis of the rotary drive shaft, and center of the arc of the stopper.

The positional relationship of the center a of the arc of the stopper 160 relative to the center point b of the swash plate 60 when the swash plate 60 is at its minimum inclination position is schematically shown in FIG. 4. This positional relationship shown in FIG. 4 is determined to satisfy the following formula (2):

$$B_{min}=H\cos\theta_{min}-A\sin\theta_{min}-D/2-R \quad (2)$$

wherein, $\theta_{min}$ represents the minimum inclination angle of the swash plate 60. The above-described values A, H, and R are determined such that the values $B_{100}$ and $B_{min}$ satisfy the following formula (3):

$$B_{min}-B_{100}>0 \quad (3)$$

Since the values A, H, and R are determined to satisfy the above formula (3), the center point $b_{min}$ of the swash plate 60 at the minimum inclination angle is offset from the rotation axis M a larger distance corresponding to $\Delta H$ ($=B_{min}-B_{110}$) than the center point $b_{100}$ of the swash plate 60 at the maximum inclination angle. In other words, the center point $b_{100}$ of the swash plate 60 at the maximum inclination angle and the center point $b_{min}$ of the swash plate 60 at the minimum inclination angle are both located on the rotation axis M, or the center point $b_{100}$ at the maximum inclination angle is located on the rotation axis M or offset from the rotation axis M on one side of the rotation axis corresponding to the compression-end circumferential part 110 of the swash plate 60, while the center point $b_{min}$ at the minimum inclination angle is offset a larger distance from the rotation axis M than the center point $b_{100}$ at the maximum inclination angle. In the present embodiment, the center point $b_{100}$ of the swash plate 60 at the maximum inclination angle is located on the rotation axis M, while the center point $b_{min}$ at the minimum inclination angle is located on one side of the rotation axis M corresponding to the compression-end circumferential part 110.

Figure 5:
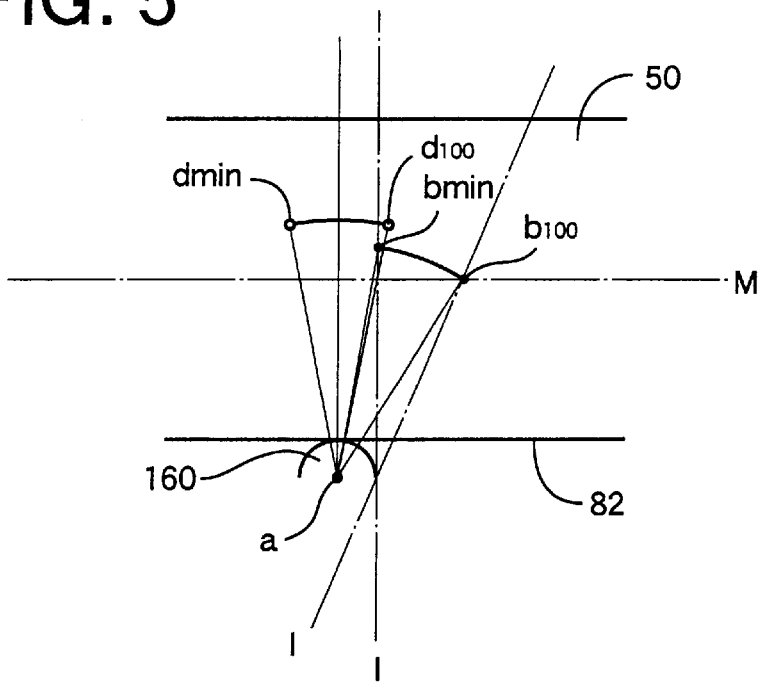
FIG. 5 is a schematic view showing a relative positional relationship of the center points and centers of gravity of the swash plate at the maximum and minimum inclination angles, and the center of the arc of the stopper.

FIG. 5 schematically shows a relative positional relationship of the center points $b_{min}$ and $b_{100}$ of the swash plate 60 at the minimum inclination angle and the maximum inclination angle, respectively, a center of gravity $d_{min}$ of the swash plate 60 at the minimum inclination angle and a center of gravity $d_{100}$ at the maximum inclination angle, the center a of the arc of the stopper 160, and the rotation axis M of the rotary drive shaft. In actual operation of the compressor, the position of the stopper 160 is moved in opposite two axial directions of the rotary drive shaft 50 when the inclination angle of the swash plate 60 is changed. For easier understanding, the position of the stopper 160 is fixed in FIG. 5. FIG. 5 shows a difference between the distance of the center point $b_{min}$ from the rotation axis M and the distance of the center point $b_{100}$ from the rotation axis M, and a difference between the distance of the center of gravity $b_{min}$ from the rotation axis M and the distance of the center of gravity $b_{100}$ from the rotation axis M. As described above, the center point $b_{100}$ of the swash plate 60 at the maximum inclination angle and the center point $b_{min}$ at the minimum inclination angle are both located on the rotation axis M, or the center point $b_{100}$ is located on the rotation axis M or offset from the rotation axis M on one side of the axis M corresponding to the compression-end circumferential part of the swash plate 60, while the center point $b_{min}$ is offset a larger distance from the rotation axis M than the center point $b_{100}$. In the present embodiment shown in FIG. 5, the center of gravity of the swash plate 60 is offset a larger distance from the rotation axis M than the center point thereof, and located on one of opposite sides of the intermediate plane 1, which side is nearer to the engaging protrusion 80. Described in detail, the center of gravity $d_{min}$ of the swash plate 60 at the minimum inclination angle and the center of gravity $d_{100}$ at the maximum inclination angle are both located on one side of the rotation axis M corresponding to the compression-end circumferential part 110 of the swash plate 60, and the centers of gravity $d_{min}$ and $d_{100}$ are offset an equal distance from the rotation axis M.

Figure 6:
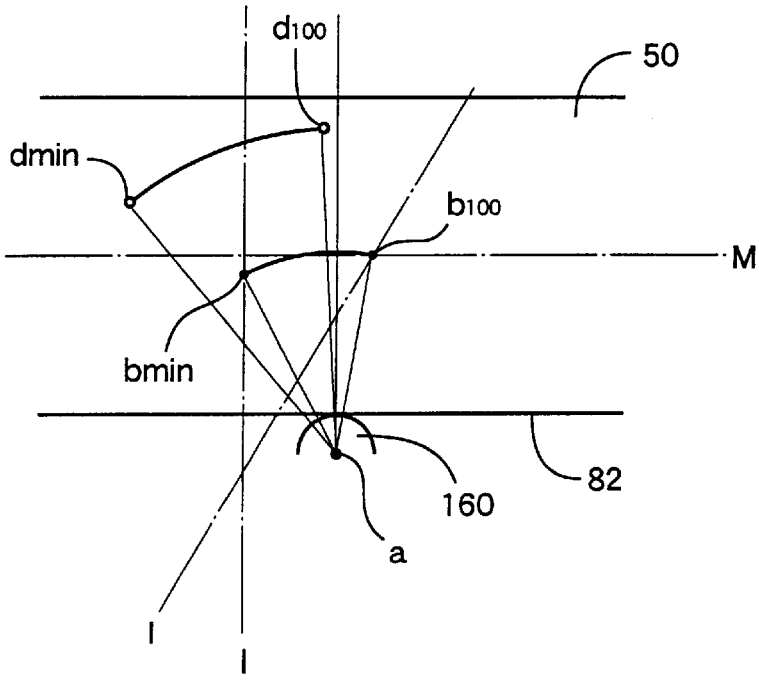
FIG. 6 is a schematic view showing a relative positional relationship of the center points and centers of gravity of the swash plate at the maximum and minimum inclination angles, and the center of the arc of the stopper in a conventional swash plate type compressor.

In contrast, in the conventional swash plate type compressor of variable capacity type, the center point of the swash plate 60 is changed as shown in FIG. 6, with a decrease of the inclination angle of the swash plate 60. Described in detail, the center point $b_{100}$ of the swash plate 60 at the maximum inclination angle, which is located on the rotation axis M, is moved by a slight distance to one side of the rotation axis M corresponding to the compression-end circumferential part 110 of the swash plate 60 with a decrease of the inclination angle of the swash plate 60, and then moved to the other side of the rotation axis M corresponding to the suction-end circumferential part 112 with a further decrease of the inclination angle of the swash plate 60. As a result, the center point $b_{min}$ at the minimum inclination angle is located on the other side of the rotation axis M corresponding to the suction-end circumferential part 112. The center of gravity of the swash plate 60 of the conventional compressor is located on one of opposite sides of its intermediate plane 1, which side is nearer to the engaging protrusion 80. Described in detail, the center of gravity $d_{100}$ is offset a larger distance from the rotation axis M on the side of the compression-end circumferential part 110 of the swash plate 60 than the center of gravity $d_{min}$ at the minimum inclination angle.

In the conventional compressor designed as described above, the swash plate 60 at the maximum inclination angle receives the centrifugal force acting thereon in a direction from the suction-end circumferential part 112 toward the compression-end circumferential part 110, while the swash plate 60 at the minimum inclination angle receives the centrifugal force which acts thereon in the same direction but whose magnitude is smaller than that at the maximum inclination angle. Although the swash plate 60 at the maximum inclination angle receives the force acting thereon in the direction from the suction-end circumferential part 112 toward the compression-end circumferential part 110 owing to the effect of the inclined surface, the swash plate 60 at the maximum inclination angle also receives the centrifugal force in the same direction whose magnitude is larger than that at the minimum inclination angle. For assuring the stable behavior of the swash plate 60, it is preferable that the stopper 160 formed on the suction-end side inner circumferential surface of the through-hole 64 of the swash plate 60 is kept in pressing contact with the outer circumferential surface 82 of the rotary drive shaft 50 during operation of the compressor. If the swash plate 60 at the maximum inclination angle, however, received the centrifugal force whose magnitude is larger than necessary, the dynamic balance of the rotating unit of the compressor including the swash plate 60 would undesirably deteriorate. In view of this, in the conventional compressor, the center of gravity of the rotary member 66 is located on the other side of the rotation axis M corresponding to the suction-end circumferential part 112 of the swash plate 60 by providing a counter weight (balancing weight) on the rotary member 66, so as to offset the centrifugal force acting on the swash plate 60 by the centrifugal force acting on the rotary member 66. Since the difference between the magnitude of the centrifugal force at the maximum inclination angle of the swash plate 60 and the magnitude of the centrifugal force at the minimum inclination angle is considerably large as described above, it is difficult to effectively reduce dynamic imbalance of the rotating unit of the compressor by the constant centrifugal force of the rotary member 66, both when the swash plate 60 is at the maximum inclination angle and when the swash plate 60 is at the minimum inclination angle. In addition, the counter weight provided on the rotary member 66 undesirably increases the overall weight of the rotating unit of the compressor.

The swash plate type compressor constructed according to the present embodiment is free from the above-described problems as experienced in the conventional compressor. In the present swash plate type compressor wherein a distance $B_{min}$ between the center point $b_{min}$ of the swash plate 60 at the minimum inclination angle and the rotation axis M is made larger than a distance $B_{100}$ between the center point $b_{100}$ at the maximum inclination angle and the rotation axis M, the center of gravity $d_{min}$ of the swash plate 60 at the minimum inclination angle is not located on one side of the center of gravity $d_{100}$ at the maximum inclination angle corresponding to the suction-end circumferential part 112 of the swash plate 60. Accordingly, the swash plate 60 at the minimum inclination angle receives the centrifugal force acting thereon in the direction from the suction-end circumferential part 112 toward the compression-end circumferential part 110. Though the effect of the inclined surface described above is not substantially expected while the swash plate 60 is at the minimum inclination angle, the centrifugal force acting on the swash plate 60 in the direction described above permits the stopper 160 to be effectively kept in pressing contact with the outer circumferential surface 82 of the rotary drive shaft 50. Therefore, the angle of inclination of the swash plate 60 can be changed with high stability while the radial movement of the swash plate 60 is limited.

In the present arrangement, the path of the center of gravity of the swash plate 60 between $d_{min}$ at the minimum inclination angle and $d_{100}$ at the maximum inclination angle is substantially parallel with the rotation axis M. Accordingly, the present arrangement permits the swash plate 60 to receive the centrifugal force acting thereon in the direction from the suction-end circumferential part 112 toward the compression-end circumferential part 110 with high stability while lowering the maximum value of the centrifugal force to a required level. In the present arrangement wherein the path of the center of gravity of the swash plate 60 between $d_{min}$ at the minimum inclination angle and $d_{100}$ at the maximum inclination angle is substantially parallel to the rotation axis M, the centrifugal force acting on the swash plate 60 is kept substantially constant irrespective of the inclination angle of the swash plate 60. Accordingly, the dynamic imbalance of the rotating unit of the compressor can be substantially entirely eliminated by the constant centrifugal force acting on the rotary member 66. In the present embodiment, since the maximum value of the centrifugal force acting on the swash plate 60 can be minimized to a required level, the dynamic imbalance of the rotating unit is relatively small even when the center of gravity of the rotary member 66 is located on the rotation axis M. Therefore, the present arrangement does not require any special means for locating the center of gravity of the rotary member 66 on the other side of the rotation axis M corresponding to the suction-end circumferential part 112 of the swash plate 60. Even if it is required to locate the center of gravity of the rotary member 66 as described above, such locating means can be small in the present arrangement. For instance, where the counter weight is provided on the rotary member 66 for locating its center of gravity on the other side of the rotation axis M corresponding to the suction-end circumferential part 112 of the swash plate 60, the mass of the counter weight can be made small in the present arrangement.

Figure 7:
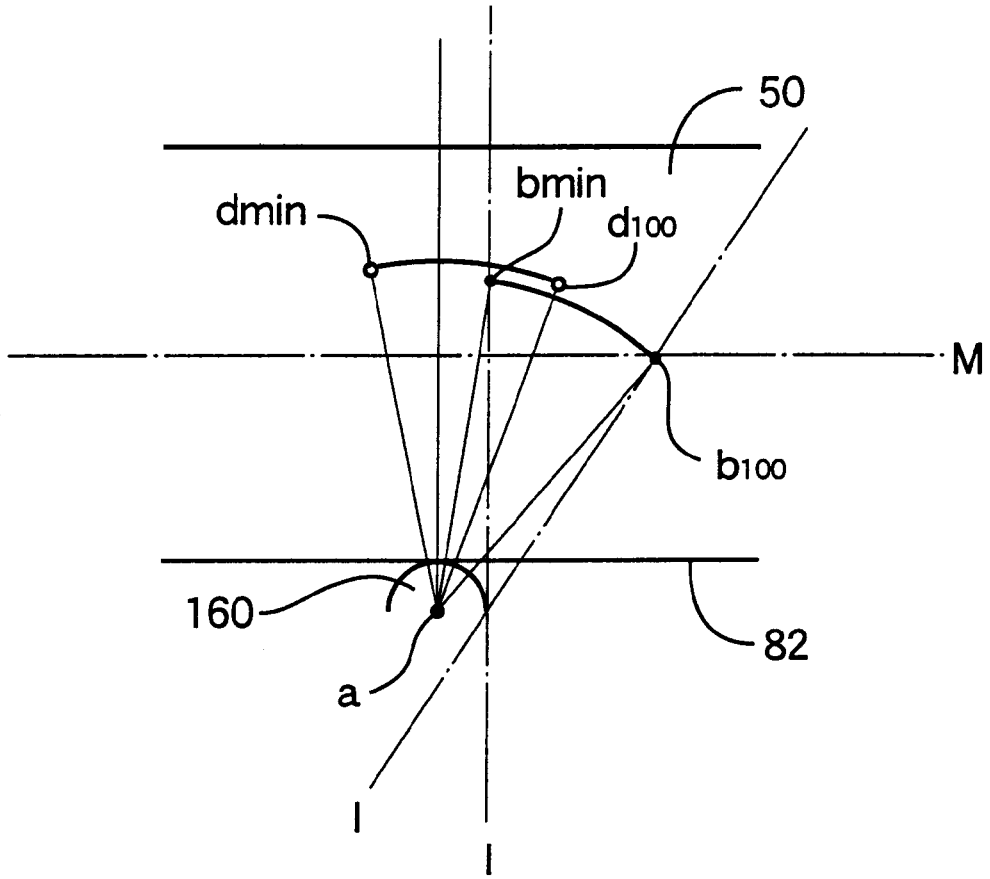
FIG. 7 is a schematic view showing a relative positional relationship of the center points and centers of gravity of the swash plate at the maximum and minimum inclination angles, and the center of the arc of the stopper in a swash plate type compressor constructed according to another embodiment of the invention.

FIG. 7 shows a relative positional relationship of the center points $b_{min}$, $b_{100}$ of the swash plate 60 at the minimum and maximum inclination angles, respectively, the centers of gravity $d_{min}$, $d_{100}$ of the swash plate 60 at the maximum and minimum inclination angles, respectively, the rotation axis M of the rotary shaft 50, and the center a of the arc of the stopper 160 in the compressor constructed according to another embodiment of the present invention. Described more specifically, the center point $b_{100}$ at the maximum inclination angle and the center point $b_{min}$ at the minimum inclination angle are both located on the rotation axis M, or the center point $b_{100}$ is located on the rotation axis M or offset from the rotation axis M on the side of the compression-end circumferential part 110 of the swash plate 60 while the center point $b_{min}$ is offset a larger distance from the rotation axis M than the center point $b_{100}$. Further, the center of gravity $d_{100}$ at the minimum inclination angle and the center of gravity $d_{100}$ at the maximum inclination angle are both located on one side of the rotation axis M corresponding to the compression-end circumferential part 110 of the swash plate 60, and the center of gravity $d_{min}$ is offset a larger distance from the rotation axis M than the center of gravity $d_{100}$. According to this arrangement, the magnitude of the centrifugal force acting on the swash plate 60 at the minimum inclination angle can be made larger than that of the centrifugal force acting on the swash plate 60 at the maximum inclination angle, for thereby assuring optimum behavior of the swash plate 60. In other words, the magnitude of the centrifugal force can be made small with an increase of the magnitude of the force acting on the swash plate 60 in the direction from the suction-end circumferential part 112 toward the compression-end circumferential part 110 owing to the effect of the inclined surface, which increase results from an increase of the inclination angle of the swash plate 60. In the present arrangement, the magnitude of the centrifugal force acting on the swash plate 60 in the direction from the suction-end circumferential part 112 toward the compression-end circumferential part 110 is large at the minimum inclination of the swash plate 60 where the effect of the inclined surface is not expected, while the magnitude of the centrifugal force is small at the maximum inclination of the swash plate 60 where the force acting on the swash plate 60 in the direction from the suction-end circumferential part 112 toward the compression-end circumferential part 110 is assured owing to the effect of the inclined surface. If the compressor is designed such that the increase of the effect of the inclined surface and the decrease of the centrifugal force are offset relative to each other, the swash plate 60 is biased in the direction from the suction-end circumferential part 112 toward the compression-end circumferential part 110 with a force whose magnitude is constant irrespective of a change of the inclination angle. Further, if the magnitude of the centrifugal force acting on the swash plate 60 at the minimum inclination is minimized to a required level, the magnitude of the centrifugal force decreases with an increase of the inclination angle of the swash plate 60. Accordingly, in the present embodiment, an average value of the magnitude of the centrifugal force acting on the swash plate 60 over the entire range of the inclination angle of the swash plate 60 is smaller than that in the embodiment of FIG. 5. Therefore, the vibration in the compressor which does not employ any special means to remove the dynamic imbalance caused by locating the center of gravity of the rotary member 66 on the other side of the rotation axis M corresponding to the suction-end circumferential part 112 of the swash plate 60, can be made smaller than the vibration in the compressor of the embodiment of FIG. 5, in any operating condition of the compressor, except the operating condition in which the discharge capacity of the compressor is minimum.

The construction of the swash plate type compressor according to the present invention is not limited to that of FIG. 1. For instance, the solenoid-operated control valve 124 is not essential, and the compressor may use a shut-off valve which is mechanically opened and closed depending upon a difference between the pressures in the crank chamber 122 and the discharge chamber 24. In place of or in addition to the control valve 124, a solenoid-operated control valve similar to the control valve 124 may be provided in the bleeding passage 130. Alternatively, a shut-off valve may be provided, which, is mechanically opened or closed depending upon a difference between the pressures in the crank chamber 122 and the suction chamber 22.

While the presently preferred embodiments of this invention have been described above, for illustrative purpose only, it is to be understood that the present invention may be embodied with various changes and improvements such as those described in the SUMMARY OF THE INVENTION, which may occur to those skilled in the art.

What is claimed is:

1. A swash plate type compressor of variable capacity type comprising:

a housing having a plurality of cylinder bores formed therein such that said cylinder bores are arranged along a circle whose center lies on a centerline of said housing;

a rotary drive shaft which is rotatably supported by said housing such that an axis of rotation of said rotary drive shaft is aligned with said centerline of said housing;

a swash plate which is carried by said rotary drive shaft such that an angle of inclination of said swash plate with respect to a plane perpendicular to said axis of rotation of said rotary drive shaft is variable, and such that said swash plate is rotated together with said rotary drive shaft;

a plurality of pistons which are slidably fitted in the respective cylinder bores and which engage a radially outer portion of said swash plate, each of said pistons being reciprocated between a compression stroke end and a suction stroke end by rotation of said swash plate, said radially outer portion of said swash plate including a compression-end circumferential part which engages each piston when each piston is located at said compression stroke end;

a swash plate angle adjusting device for adjusting said angle of inclination of said swash plate between a minimum inclination angle and a maximum inclination angle, and wherein said swash plate has a first center point at the maximum inclination angle and a second center point at the minimum inclination angle, each of said first and second center points being an intersection between an intermediate plane of said swash plate which is intermediate in a direction of thickness thereof and a centerline of said swash plate, (a) said first center point and said second center point being located on said axis of rotation of said rotary drive shaft, or (b) said first center point being located on said axis of rotation or offset from said axis of rotation on one side of said axis of rotation, which one side corresponds to said compression-end circumferential part of said swash plate, while said second center point is offset a larger distance from said axis of rotation than said first center point.

2. A swash plate type compressor of variable capacity type comprising:

a housing having a plurality of cylinder bores formed therein such that said cylinder bores are arranged along a circle whose center lies on a centerline of said housing;

a rotary drive shaft which is rotatably supported by said housing such that an axis of rotation of said rotary drive shaft is aligned with said centerline of said housing; a swash plate which is carried by said rotary drive shaft such that an angle of inclination of said swash plate with respect to a plane perpendicular to said axis of rotation of said rotary drive shaft is variable, and such that said swash plate is rotated together with said rotary drive shaft;

a plurality of pistons which are slidably fitted in the respective cylinder bores and which engage a radially outer portion of said swash plate, each of said pistons being reciprocated between a compression stroke end and a suction stroke end by rotation of said swash plate, said radially outer portion of said swash plate including a compression-end circumferential part which engages each piston when each piston is located at said compression stroke end;

a swash plate angle adjusting device for adjusting said angle of inclination of said swash plate between a minimum inclination angle and a maximum inclination angle, and wherein said swash plate has a first center of gravity at the maximum inclination angle and a second center of gravity at the minimum inclination angle, said first center of gravity and said second center of gravity being located on said axis of rotation of said rotary shaft or offset a substantially equal distance from said axis of rotation on one side of said axis of rotation, which one side corresponds to said compression-end circumferential part of said swash plate.

3. A swash plate type compressor of variable capacity type comprising:

a housing having a plurality of cylinder bores formed therein such that said cylinder bores are arranged along a circle whose center lies on a centerline of said housing;

a rotary drive shaft which is rotatably supported by said housing such that an axis of rotation of said rotary drive shaft is aligned with said centerline of said housing;

a swash plate which is carried by said rotary drive shaft such that an angle of inclination of said swash plate with respect to a plane perpendicular to said axis of rotation of said rotary drive shaft is variable, and such that said swash plate is rotated together with said rotary drive shaft;

a plurality of pistons which are slidably fitted in the respective cylinder bores and which engage a radially outer portion of said swash plate, each of said pistons being reciprocated between a compression stroke end and a suction stroke end by rotation of said swash plate, said radially outer portion of said swash plate including a compression-end circumferential part which engages each piston when each piston is located at said compression stroke end;

a swash plate angle adjusting device for adjusting said angle of inclination of said swash plate between a minimum inclination angle and a maximum inclination angle, and wherein said swash plate has a first center of gravity at the maximum inclination angle and a second center of gravity at the minimum inclination angle, said second center of gravity being offset from said first center of gravity on the side of said compression-end circumferential part of said swash plate.

4. A swash plate type compressor according to claim 3, wherein said second center of gravity is located on said axis of rotation of said rotary drive shaft or offset from said axis of rotation on one side of said axis of rotation, which one side corresponds to said compression-end circumferential part of said swash plate.

5. A swash plate type compressor according to claim 1, further comprising:

a first engaging portion which is offset from said axis of rotation of said rotary drive shaft and which is rotatable together with said rotary drive shaft; and a second engaging portion which is fixed to said swash plate and which engages said first engaging portion such that said swash plate is tiltable relative to said axis of rotation of said rotary drive shaft so as to change said angle of inclination thereof, and such that said swash plate is inhibited from rotating relative to said rotary drive shaft.

6. A swash plate type compressor according to claim 5, wherein said first engaging portion is provided on a rotary member which is fixed to the rotary drive shaft.

7. A swash plate type compressor according to claim 6, wherein said radially outer portion of said swash plate further includes a suction-end circumferential part which engages each piston when each piston is located at said suction stroke end, said suction-end circumferential part being opposite to said compression-end circumferential part diametrically of said rotary drive shaft, and wherein said rotary member has a center of gravity which is located on said axis of rotation of said rotary drive shaft or offset from said axis of rotation on the other side of said axis of rotation corresponding to said suction-end circumferential part of said swash plate.

8. A swash plate type compressor according to claim 5, wherein said first engaging portion comprises an engaging hole having a circular shape in transverse cross section, and said second engaging portion is a protruding member which protrudes from a body portion of said swash plate such that said protruding member is inclined with respect to the intermediate plane of said swash plate, said protruding member having at a distal end thereof a spherical portion which is slidably fitted into said engaging hole of said first engaging portion.

9. A swash plate type compressor according to claim 1, further comprising a stopper for limiting a movement of said swash plate relative to said rotary drive shaft in a direction from said suction-end circumferential part of said swash plate toward said compression-end circumferential part of said swash plate, said stopper being formed at a portion of an inner circumferential surface of a through-hole formed through a central part of said swash plate, which portion is located on the side of said suction-end circumferential part of said swash plate, said stopper limiting said movement of said swash plate by a contact thereof with a corresponding portion of an outer circumferential surface of said rotary drive shaft.

10. A swash plate type compressor according to claim 9, wherein said stopper has a curved shape in cross section in a plane which passes said compression-end circumferential part of said swash plate and said suction-end circumferential part of said swash plate and which includes said rotation axis of said rotary drive shaft.

11. A swash plate type compressor according to claim 10, wherein said curved cross sectional shape of said stopper is arcuate.

* * * * *

UNITED STATES PATENT AND TRADEMARK OFFICE

CERTIFICATE OF CORRECTION

PATENT NO. : 6,508,633 B2
DATED : January 21, 2003
INVENTOR(S) : Matsubara et al.

It is certified that error appears in the above-identified patent and that said Letters Patent is hereby corrected as shown below:

Column 5,
Line 52, please delete "end side; it is" and insert therefore -- end side, it is --;

Column 12,
Line 4, please delete "hemispherical" and insert therefore -- hemi-spherical --;
Line 42, please delete "piston, 14 when each" and insert therefore -- piston 14 when each --;
Line 45, please delete "diametrically of :the" and insert therefore
-- diametrically of the --;
Line 51, please put a hard return after "swash plate 60." and begin
"The above-described values…" as a new paragraph.

Signed and Sealed this

Eighth Day of April, 2003

JAMES E. ROGAN
*Director of the United States Patent and Trademark Office*